US005638981A

United States Patent [19]

Crane et al.

[11] Patent Number: 5,638,981

[45] Date of Patent: Jun. 17, 1997

[54] TABLEWARE WITH UTENSIL SUPPORT

[75] Inventors: Kathryn Crane, 4940 Ridgewood Rd., Jackson, Miss. 39211; Walter Gillis, Jackson, Miss.

[73] Assignee: Kathryn Crane, Jackson, Miss.

[21] Appl. No.: 611,989

[22] Filed: Mar. 5, 1996

[51] Int. Cl.[6] ..... A47G 19/02; A47G 19/06

[52] U.S. Cl. ..... 220/574.1; 220/608

[58] Field of Search ..... 220/574, 574.1, 220/575, 608; D7/505, 507, 543, 585, 588; 434/112, 113, 127

[56] References Cited

U.S. PATENT DOCUMENTS

| | | | |
|---|---|---|---|
| D. 163,017 | 4/1951 | Blancheri | D7/588 X |
| D. 364,998 | 12/1995 | Held | D7/585 X |
| 1,272,996 | 7/1918 | Poschadel | 220/575 |
| 2,642,731 | 6/1953 | Valenti | 220/574 |
| 4,986,434 | 1/1991 | Prestyly, Jr. | 220/574 |
| 5,065,889 | 11/1991 | Conti | 220/574 X |
| 5,088,640 | 2/1992 | Littlejohn | 220/574 X |
| 5,139,166 | 8/1992 | Smith | 220/574 |
| 5,152,690 | 10/1992 | Todd | 434/112 X |
| 5,234,125 | 8/1993 | Roberts | 220/574 |
| 5,242,078 | 9/1993 | Haas et al. | 220/574 |
| 5,269,717 | 12/1993 | Tardif | 220/574 X |
| 5,542,565 | 8/1996 | Hidalgo-Lopez | 220/574.1 |

FOREIGN PATENT DOCUMENTS

| | | | |
|---|---|---|---|
| 2263269 | 7/1993 | United Kingdom | 434/113 |

*Primary Examiner*—Allan N. Shoap
*Assistant Examiner*—Niki M. Kopsidas
*Attorney, Agent, or Firm*—William W. Jones

[57] ABSTRACT

Tableware in the form of a plate is provided with a conventional food-receiving surface, which food-receiving surface is formed with a hollowed out recess which is sized to snugly receive the bowl of a spoon or fork. The hollowed out recess is operable to locate the edge of the bowl of the eating utensil at or below the food-receiving surface of the plate so that food can be smoothly slid from the plate onto the utensil bowl. The handle of the utensil rests on the edge of the plate when the utensil bowl is disposed in the plate recess so that a person is able to use only one hand to position the utensil properly on the plate; sweep food into the utensil bowl with the same hand; and to pick up the utensil with the same hand to consume the food in the utensil bowl. A plate which is configured with the utensil-receiving recess enables one to use only one hand to consume food from the plate. The plate can thus be used to train a young child to feed itself, or it can be used to enable physically challenged individuals to feed themselves without assistance.

6 Claims, 1 Drawing Sheet

TABLEWARE WITH UTENSIL SUPPORT

TECHNICAL FIELD

This invention relates to tableware in the form of a dinner plate, and more particularly to a plate which is formed with a food-receiving surface having a hollowed out recess that is sized to snugly, but removably, receive the bowl of a spoon or fork.

BACKGROUND ART

Tableware, such as plates, bowls, platters, and the like have been provided with various modifications which are designed to co-operate in diverse ways with utensils such as spoons, forks, and the like. For example, U.S. Pat. No. 269,054 discloses a cooking vessel which has a specially configured rim that engages the handle of a spoon to prevent the spoon from sliding into the vessel. British Patent No. 117,379 (1918) describes a meat carving platter which has a specially configured surface that supports the meat being carved, and a well for gravy from the meat, which well is configured to hold a spoon for removing the gravy from the platter. U.S. Pat. No. 4,986,434 discloses a dish which is provided with a cavity on one side of the dish, which cavity is operable to receive a food such as spaghetti, and to allow a fork to be inserted into the cavity to facilitate removal of the spaghetti from the dish. U.S. Pat. No. 5,172,826 describes a food bowl which includes a depression in its bottom for collecting the last of foods remaining in the bowl so that the bowl does not have to be tipped in order to spoon the remainder of the food in the bowl. The aforesaid food bowls, dishes, and the like are not designed for any particular segment of the general populace, each being designed for use in limited environs, and useful only in particular situations.

It would be desirable to have a dinner plate which would simplify the consumption of food for infants, and for handicapped individuals. More particularly, it would be desirable to have a dinner plate which could be readily used by an individual having deft use of only one hand.

DISCLOSURE OF THE INVENTION

This invention relates to a dinner plate which is provided with a food-receiving surface that has a hollowed out recess which is sized to snugly receive the bowl of a spoon or fork. The hollowed recess in the top surface of the plate serves to lower the food supporting surface of the spoon or fork so that it will be below the top surface of the plate. An individual using the plate and the spoon or fork (utensil) who has the use of only one hand can easily place the utensil in the recess with one hand, release the utensil, and then sweep food onto the bowl of the utensil with the one good hand. Once the utensil has been filled with food, the utensil can then be picked up with the one good hand so that the food can be consumed. The food can be swept onto the utensil with a knife or some other specifically configured implement. The recess will preferably include an undercut lip which engages the leading edge of the utensil so that the utensil will actually be cantilevered in the recess. In this way, the handle of the utensil can be elevated above the rim of the plate. The plate rim may also be provided with grooves which can cradle the handles of the utensil and the food sweeping implement, or provide an increased degree of elevation of the utensil handle above the rim of the plate. The rim of the plate can also be provided with Braille indicia which indicate the location of different foods on the plate, which indicia are disposed at a predetermined angular relationship to the utensil, so that the plate/utensil combination can be readily used by the blind.

It is therefore an object of this invention to provide a dinner plate which can be used by an individual who has dexterous use of only one hand.

It is a further object of this invention to provide a dinner plate of the character described which is operable to support a spoon, fork, or other utensil in a set position on the food-supporting surface of the plate so that food can be swept onto the utensil from the plate.

It is another object of this invention to provide a dinner plate of the character described wherein the bowl of the utensil is disposed below the food-supporting surface of the plate and securely held in position on the plate.

It is an additional object of this invention to provide a dinner plate of the character described wherein the utensil is cantilevered on the food-supporting surface of the plate and the handle of the utensil is elevated above the rim of the plate.

It is yet another object of this invention to provide a dinner plate of the character described wherein the bowl of the utensil fills a utensil-supporting recess in the top surface of the plate.

These and other objects and advantages of the invention will become more readily apparent from the following detailed description of the invention when taken in conjunction with the accompanying drawings in which:

DETAILED DESCRIPTION OF THE INVENTION

Figure 1:
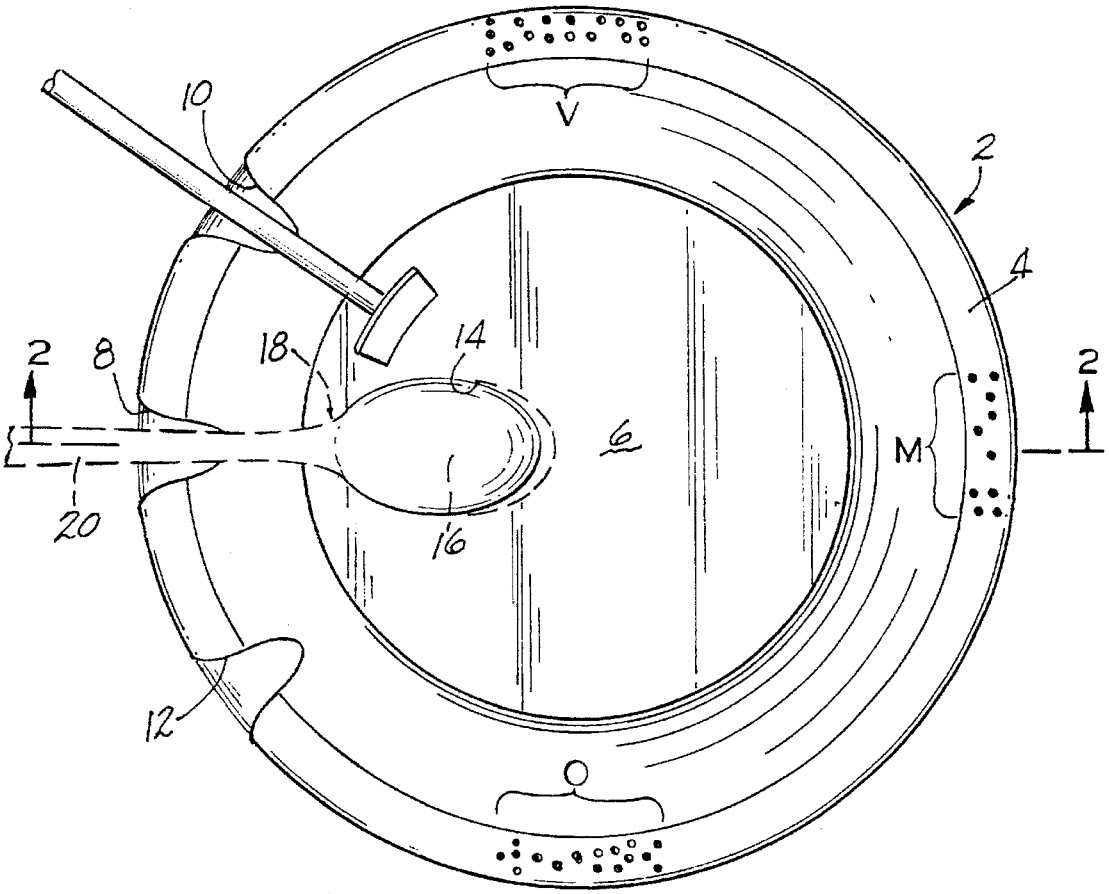
FIG. 1 is a plan view of a preferred embodiment of a dinner plate formed in accordance with this invention.

Referring now to the drawings, there is shown in FIG. 1 a preferred embodiment of a dinner plate formed in accordance with this invention and which is denoted generally by the numeral 2. The plate 2 includes a rim 4 which is elevated above and surrounds a central food-receiving surface 6. The rim 4 may be provided with a plurality of concavities 8, 10 and 12. The plate surface 6 includes a hollowed out recess 14 which is sized and configured to snugly receive the bowl 16 of a spoon 18 (shown in phantom) or other flatware utensil. The concavity 8 is disposed beneath the handle 20 of the spoon 18 so that the spoon handle 20 will be upwardly offset from the rim 4 of the plate 2. This permits the spoon handle 20 to be easily grasped by the individual using the plate and spoon. The concavities 10 and 12 are provided so that a pusher implement, i.e., a knife, or some other implement such as a food pusher, such as is shown in the concavity 10, having a handle and a head, can be positively located on the rim 4 of the plate 2. The concavity 10 may be useful to a left-handed person, and the concavity 12 may be useful to a right-handed person. The rim 4 of the plate 2 may be provided with a plurality of Braille imprints which are offset by known angles from the utensil concavity 8. These imprints can be used to indicate to a blind user to location of various food types on the plate 2. One Braille imprint set V can be used to indicate the location of vegetables on the plate 2; a second Braille imprint set M can be used to indicate the location of meat on the plate 2, and a third Braille imprint set O can be used to indicate the location of other food types on the plate 2. In the embodiment shown in FIG. 1, the Braille imprint sets are arranged at 90° angles relative to each other and to the utensil concavity 8. Obviously, more or fewer than three Braille imprint sets could be disposed on the plate rim 4, and various angular offsets could be used.

Figure 2:
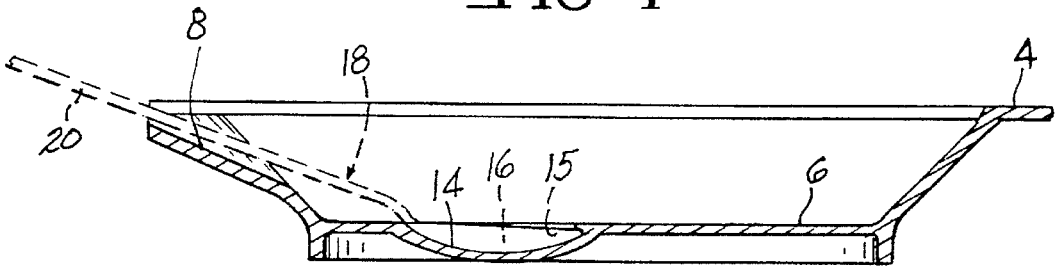
FIG. 2 is a sectional view of the plate taken along lines 2—2 of FIG. 1.
Figure 3:
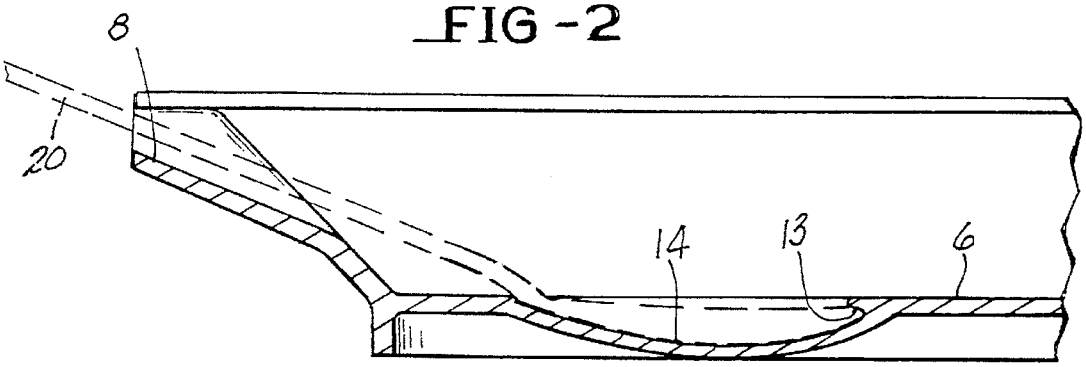
FIG. 3 is an enlarged fragmented sectional view of the utensil-retaining recess in the plate.

Referring now to FIGS. 2 and 3, the manner in which the spoon 18 is held in place in the plate 2 is shown. It will be noted that the bowl 16 of the spoon 18 is positioned well below the surface 6 of the plate 2 so that food can be swept from the plate surface 6 onto the spoon surface 16. The plate recess 14 is preferably provided with a lip 13 (best shown in FIG. 3) which engages the edge 15 of the bowl 16 of the spoon 18 (as best shown in FIG. 2). The plate recess lip 13 is thus operable to tilt the spoon 18 to a degree necessary to cantilever the spoon 18 on the plate 2. The handle 20 of the spoon 18 is thus readily accessible to the user, and the bowl 16 of the spoon 18 is also positively held in place in the plate recess 14. Once the spoon bowl 16 is filled with food, the spoon 18 can be easily slipped rearwardly out of the plate recess 14 to enable the user to consume the food on the spoon 18. The fact that the spoon 18, or other utensil is held snugly in the plate recess 14 during meal time ensures that food will not slip into the recess 14.

It will be readily appreciated that the plate and utensil combination of this invention can be easily used by a person having the use of only one hand. The utensil fits snugly in the plate recess so that food swept toward the recess will end up on the utensil. The utensil is cantilevered on the plate by reason of its engagement with the recess, so that the utensil handle will be elevated above the rim of the plate making it easy for the user to grasp the utensil handle. It will also be appreciated that the invention can be used by a blind person.

Since many changes and variations of the disclosed embodiments of the invention may be made without departing from the inventive concept, it is not intended to limit the invention otherwise than as required by the appended claims.

What is claimed is:

1. A dinner plate which is adapted for use by a physically-challenged individual, said dinner plate including a central food-supporting surface, said food-supporting surface including a localized recess which is sized to snugly receive an eating utensil which utensil includes a food-receiving bowl and a handle, said recess having a lip which is on a side of said recess closest to the center of said plate, and said recess lip being operable to overlap and engage an edge of said utensil food-receiving bowl so as to cantilever said utensil handle above the plate, said plate also having an outer peripheral rim surrounding said food-supporting surface, said rim having a first concavity which is aligned with said recess whereby the utensil handle will be disposed within the confines of said concavity when said utensil bowl is located in said recess so as to be readily grasped by one using the dinner plate.

2. The dinner plate of claim 1 wherein said plate rim includes a second concavity laterally offset from said first concavity, said second concavity providing localized support for an auxiliary food utensil on the plate rim.

3. The dinner plate of claim 1 wherein said plate rim includes at least one Braille imprint thereon, which Braille imprint indicates the location of a particular food type on the plate.

4. In combination, a dinner plate and an eating utensil, said dinner plate being adapted for use by a physically-challenged individual, said dinner plate including a central food-supporting surface, said food-supporting surface including a localized recess which is sized to snugly receive a food-receiving bowl of said utensil, and said recess having a lip which is on a side of said recess closest to the center of said plate, and said recess lip being operable to overlap and engage an edge of a food-receiving bowl on said utensil so as to cantilever a handle on said utensil above the plate, said plate also having an outer peripheral rim surrounding said food-supporting surface, said rim having a first concavity which is aligned with said recess, whereby the utensil handle will be disposed within the confines of said concavity when said utensil bowl is located in said recess so as to be readily grasped by one using the combination.

5. The combination of claim 4 wherein said plate rim includes a second concavity laterally offset from said first concavity, said second concavity providing localized support for an auxiliary food utensil on the plate rim.

6. The combination of claim 4 wherein said plate rim includes at least one Braille imprint thereon, which Braille imprint indicates the location of a particular food type on the plate.

* * * * *